United States Patent [19]

Mills

[11] 3,962,732

[45] June 15, 1976

[54] DISPOSABLE BEDPANS

[76] Inventor: Kenneth Wilson Mills, 11 Redcar Road, Smithills Dean Bolton, Lancashire, England, BL1 2HP

[22] Filed: May 9, 1975

[21] Appl. No.: 576,020

[52] U.S. Cl. ..... 4/112
[51] Int. Cl.[2] ..... A61G 9/00
[58] Field of Search ..... 4/110, 111, 112, 113, 4/141, 142

[56] References Cited

UNITED STATES PATENTS

| | | | |
|---|---|---|---|
| 3,069,693 | 12/1962 | Brodsky | 4/112 |
| 3,160,893 | 12/1964 | Steel et al. | 4/112 |
| 3,249,950 | 5/1966 | Wilson | 4/112 |
| 3,319,263 | 5/1967 | Udden et al. | 4/112 |
| 3,444,563 | 5/1969 | Gordon, Jr. | 4/142 |
| 3,503,080 | 3/1970 | Laufer et al. | 4/112 |
| 3,599,249 | 8/1971 | Reed | 4/112 |
| 3,713,178 | 1/1973 | Mallette | 4/112 |

*Primary Examiner*—Henry K. Artis
*Attorney, Agent, or Firm*—Ulle C. Linton

[57] ABSTRACT

This invention is concerned with disposable bedpans of the kind composed of fibrous, e.g. cellulose pulp or paper, stock and which after use and together with their contents are disposed of via waste disposal apparatus to a normal drainage system, and provides a support for such a bedpan which also is disposable via the drainage system, whereby there is provided in combination a bedpan and support, an assembly which consists of a disposable bedpan fitted with a disposable support as referred to above. In a preferred form the bedpan of the assembly incorporates integral support means which enables it in same circumstances to be used when separated from its support.

5 Claims, 6 Drawing Figures

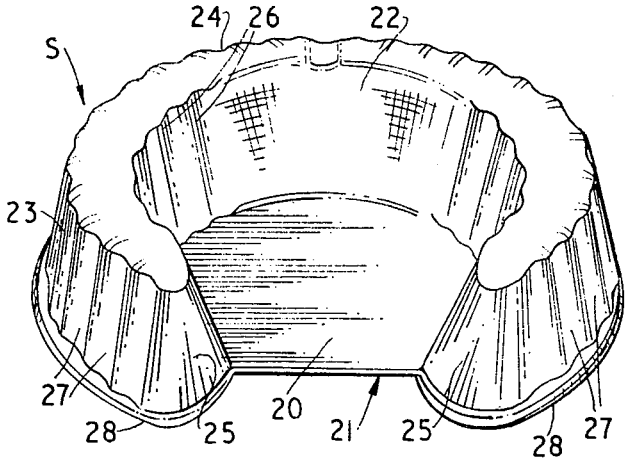
-FIG.1-
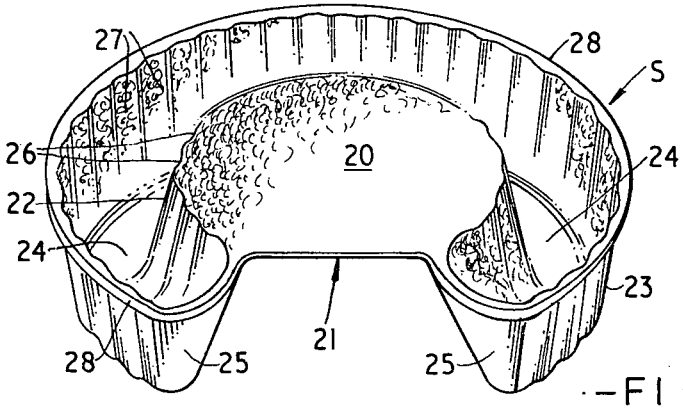
-FIG.2-
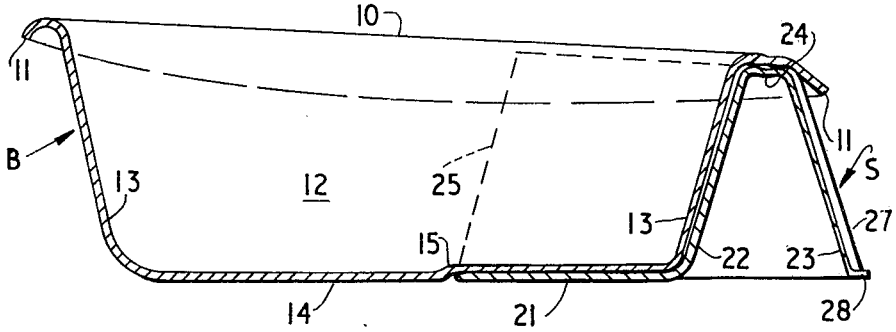
-FIG.3-

-FIG. 4-
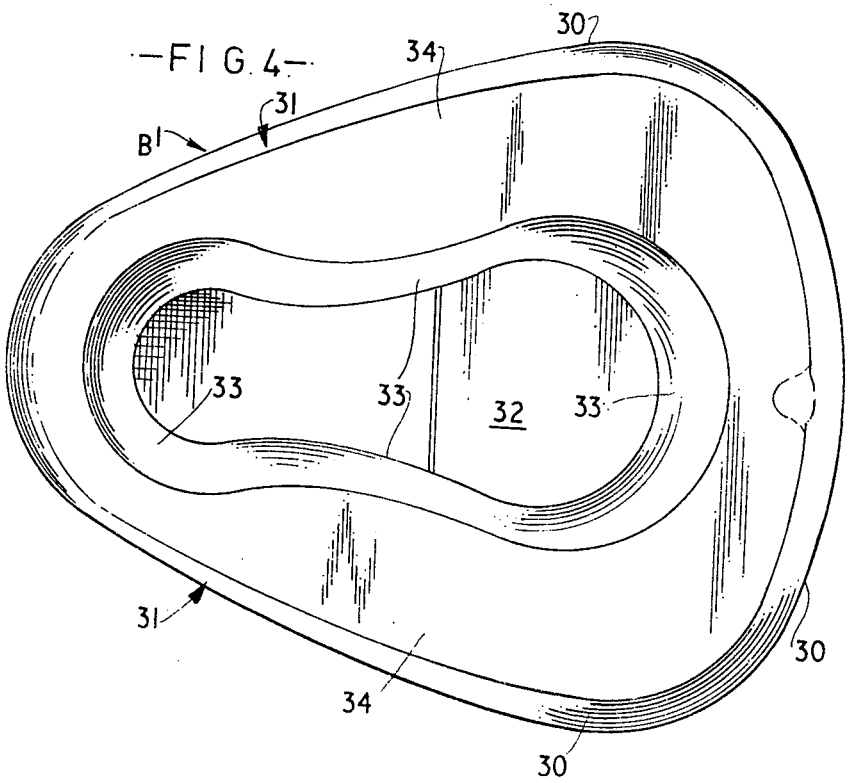
-FIG. 5-
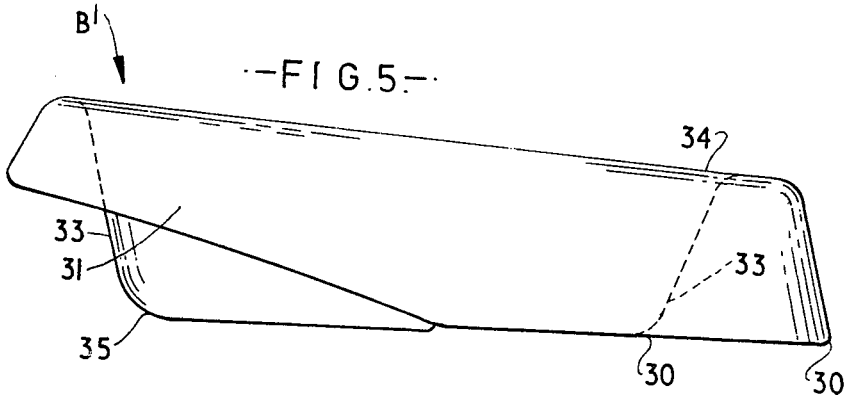

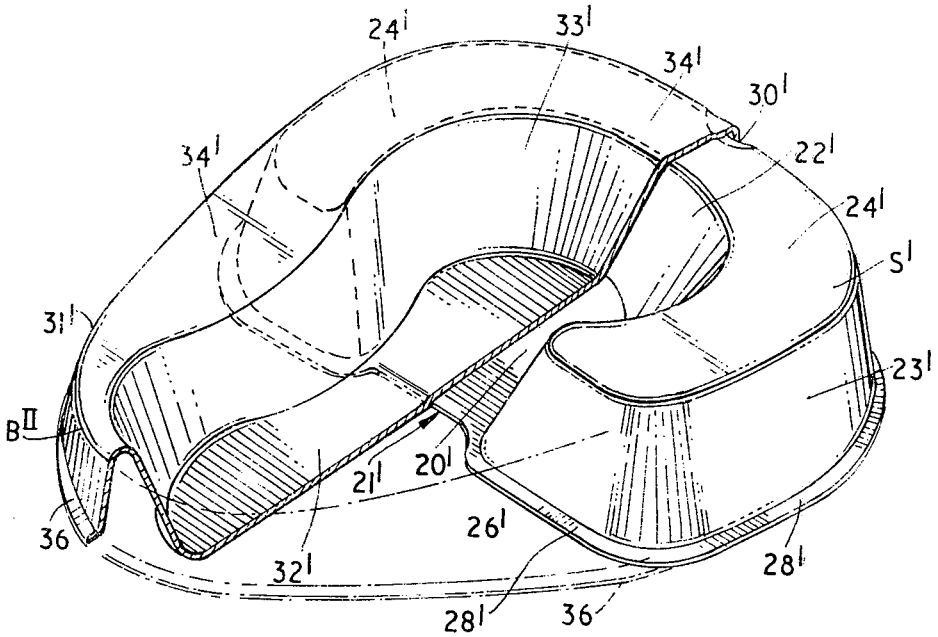
-FIG.6-

DISPOSABLE BEDPANS

This invention is concerned with disposable bedpans of the kind composed of fibrous, e.g. cellulose pulp or paper stock, and which, after use and together with their contents are disposed of in a convenient and hygienic manner, usually but not essentially via a waste disposal apparatus wherein they are comminuted or pulverized being mixed with water to an easy flowing consistency and consigned to a normal soil drain system which conveys the liquid slurry to a sewage treatment plant. Bedpans of the kind referred to comprise a seat portion formed with a downturned peripheral lip, a receptacle portion formed within the seat portion and having downwardly convergent side walls, said receptacle portion being elongated from front to rear and being bilobate in plan view with the rear part being of greatest radius.

Such bedpans as are at present widely used in hospitals throughout the United Kingdom and elsewhere overseas, are light in weight and have a thin wall section which renders them unsuitable as load-bearing units in themselves. Usually therefore a disposable bedpan is located in use within a complementary non-expendable support or carrier which may be composed of a sufficiently rigid synthetic resin capable of withstanding constant cleaning and sterilization at temperatures of the order of 130° centigrade. It will of course be appreciated that hospital staffs vary the method and the frequency of cleaning such re-usable supports in relation to the illness of the patient being nursed. For example it may be considered necessary to wash and fully sterilize the support after each use by a patient suffering from a highly infectious or contageous disease, whereas simple washing or swabbing with a Bactericide may be considered entirely adequate in respect of other patients.

Attempts have heretofore been made to provide a self-supporting, fully disposable, bedpan but the difficulty of rapid disposal, even with powerful disposal apparatus, and the nature of the fibrous pulp material used, precluded from a practical point of view its structural strength being raised to a point which obviated its tendency to collapse when used by a heavy patient, or when splints or other appliances impose high loads on local sections, or when the mattress or other supporting surface was not flat. The simple and seemingly obvious expedient of rendering a disposable bedpan sufficiently strong by increasing the wall thickness is not a practical manufacturing proposition, mainly because enclosed sections of the mould forms gather during the moulding process a disproportionately large mass of fibrous moulding material. Thus the actual strength of the load bearing parts of the article is not proportional to the increase in overall weight of the moulding material used. Even if it were possible to mould a bedpan of a strength sufficient to support a person of maximum weight, then the required mass of moulding material would be greater than is acceptable by conventional disposal means. Further, the necessary wall thicknesses would inhibit nesting with a consequent increase in the cost of manufacture, storage and transport.

The present invention has for one of its objects to provide in combination an assembly comprising a disposable bedpan of the kind referred to, a disposable bedpan support which is usable as an alternative to the non-expendable support or carrier composed of rigid synthetic resin or other suitable material to which reference has already been made. Said disposable support is designed to have a weight and bulk which enables the bedpan and the support either as an assembly or separately, to be readily disposed of by means of conventional methods and apparatus.

A further object is to provide a disposable bedpan disposable support assembly, the combined unit being designed, by the fitting together of corresponding tapered faces and/or the registration of the edges, and faces of the component parts of the assembly, to provide an adequate load-bearing capacity in those local areas where extra strength is required thus leaving without extra weight, bulk, wall thickness or additional sections, that portion of the bedpan where load-bearing is of lesser importance. By this means the amount of material to be macerated and conveyed via the soil drains to the sewage treatment plant is maintained at a minimum. Such an assembly is a valuable facility which could be used for example when it was judged that the cost of thoroughly sterilizing a non-expendable support after each use by patients afflicted by highly infectious or contageous illnesses was greater than the extra cost of the disposable bedpan-cum-support or when, in the judgement of the nursing authority concerned, it was simply desirable to use such a fully disposable utensil.

The invention also aims to provide a disposable bedpan-cum-support assembly the bedpan unit whereof is capable of, if so desired, of being detached and used with a non-expendable support such as already referred to. This combination of disposable bedpan and non-expendable support is intended for use when nursing heavy patients, when splints or appliances impose high loads on local sections, when any problem of disposal makes it imperative to minimise the amount of fibrous material passed into the soil drains, or when, in the judgement of the nursing authority concerned, it is simply desirable to use the combination of disposable bedpan and non-expendable support. Accordingly a support means for use with a disposable bedpan of the kind referred to characterised in that it is of a disposable nature similar to that of the bedpan, being composed say of a fibrous, e.g. cellulose, pulp material. Preferably said support includes a peripheral wall or skirt portion adapted to impart stability in use to the bedpan receptacle. In a preferred form, a disposable support is adapted for fittment to the rear (in use) part only of a bedpan whereby its bulk is considerably reduced making it possible for the bedpan-cum-support assembly to be consigned to and readily dealt with by a conventional waste disposal apparatus.

The improved disposable bedpan is formed with an integral outwardly and downwardly sloping support flange or skirt extending from the rear or seating portion of the bedpan which flange extends to base datum level at each side. The flange or skirt is gradually tapered upwards towards the front of the bedpan in order to minimise the material weight in this area where load bearing is of lesser importance. Such a bedpan may be used per se as a free standing, self-supporting unit where patient weight and other considerations permit. If desired however, a disposable support as above defined could be used to supplement the load-bearing properties of the improved bedpan. The bedpan may of course by used in conjunction with a rigid non-expendable support or carrier if necessary or desirable.

This free standing self-supporting improved bedpan has advantages in that it has a substantial portion of the outwardly and downwardly inclined external skirt or flange somewhat above the level of the base datum of the utensil. This has the effect of exposing the radiussed exterior face of the receptacle compartment of the bedpan, which facilitates sliding action of the utensil when it is being placed beneath a patient as compared with the outwardly angled forward projecting flanges of conventional designs which tend to dig into a bed's draw sheet and produce fractures in the fibrous material. The present bedpan, because of said tapering cutaway flange is also much easier to manipulate and obviates the danger of trapping the fingers, or damaging the material of the utensil, when a patien's weight is unexpectedly or inadvertently applied before the hand is drawn clear.

The invention is further described with the aid of the accompanying drawings which illustrate by way of example only and not of limitation several embodiments. In said drawings:

FIG. 1 is a front perspective view from above, and

FIG. 2 is a front perspective view from below, of one form of a disposable bedpan support for an assembly according to the invention.

FIG. 3 is a sectional side elevation of an assembly at the support means of FIGS. 1 and 2 with a known type of disposable bedpan.

FIG. 4 is a plan view of an improved disposable bedpan according to the present invention incorporating an integral support means, and FIG. 5 is a side elevation thereof.

FIG. 6 is a part sectional perspective view of an alternative form of disposable bedpan and support assembly according to the invention.

Referring to said drawings, the letter B in FIG. 3 denotes a disposable bedpan of a kind which is in general use and conventionally is employed with a non-disposable rigid plastics or other support or carrier. Such a bedpan comprises a seat portion 10 formed with a downturned peripheral lip 11 which is designed so as to be a free fit over and shroud the upper edge of a conventional rigid non-disposable support or carrier. Formed within the seat 10 there is a receptacle portion 12 having convergent side walls 13, said receptacle portion being elongated in a direction from front to rear and formed with a medial waist so that in plan said receptacle portion is roughly of bilobate or keyhole shape with the rear part being of greater radius than the fore part. The front of said bedpan B is some what higher than the rear part. The rear and side parts of the seat portion 10 may in some cases be formed with concavities or depressions arranged so as to render it more comfortable in use.

A disposable support S (FIGS. 1 and 2) for the bedpan B is a one piece unit moulded or pressed to shape from e.g. a cellulose pulp, and consists of a planar base 20 which is generally circular in shape but at its front is terminated by a straight chordal edge 21. Extending upwardly from the curved periphery of said base 20 is a divergent wall 22 which is joined to a divergent skirt portion 23 by an upper generally horizontal web 24. At the front of said support said wall part 22 and skirt portions 23 are connected by conic wall sections 25.

To increase the rigidity and therefore the load bearing character of the support, said wall 22 and skirt 23 may be formed with vertically extending flutes 26, 27. Said flutes 26, 27 may extend across the upper connecting web 24.

To prevent spreading of the divergent skirt portion 23 under load, the outer periphery thereof, preferably is formed with a continuous horizontal flange 28 co-planar with the base 20. As will be clear from FIG. 3, the bedpan support S is configurated so as to be a snug fit around the rear part of the said bedpan with the frontal conic portions 25 of the support being located in the waisted sides of the receptacle part 12 of the bedpan, and the upper flange 24 seated below the seat portion 10. The bedpan B is thus provided with a strong and stable support means around its rear part which in use takes up most of the weight of a person using same, and at the same time provides a lateral stability for the assembly by virtue of its outwardly extending skirt 23.

Preferably, although not essentially, the bottom 14 of the receptacle portion 12 of the bedpan is formed with a joggle 15 in order that the base 20 of the support S will lie flush with the uncovered part of said bottom 14.

Referring to FIGS. 4 and 5 these illustrate an improved disposable bedpan B′ wherein the downturned peripheral edge, which in conventional bedpans comprises only a short lip (see FIG. 3), is extended to form a downwardly and outwardly extending flange 30 around the rear part of the unit. At each side said flange 30 tapers towards the front as indicated at 31. The receptacle part 32 of the bedpan comprises downwardly convergent side walls 33 and a seat portion or web 34. In plan view said receptacle part is bilobate and the forepart has a radiussed (in side elevation) front face 35 as shown best in FIG. 5.

The integral load bearing flange 30 may have its operative stiffness increased by flutes or corrugations and a peripheral flange in the manner of the disposable support 'S' of FIGS. 1–3. The disposable bedpan of FIGS. 4 and 5 has been shown experimentally to be capable of being self-supporting under the weight of children and other relatively lightweight patients. To increase its load bearing capabilities as desired said bedpan B′ may be used either in conjunction with a disposable support S, or with a rigid non-expandable support of conventional or other type.

Referring now to FIG. 6, this illustrates the assembly of an alternative form of support S′ combined with an improved disposable bedpan $B^2$.

Said bedpan $B^2$ has basically the same characteristic shape as the bedpan B′ illustrated in FIGS. 4 and 5 in that it comprises a receptacle portion 32′, with downwardly converging walls 33′, a seat portion or web 34′, and is similarly shaped in plan. However, to improve its resistance to lateral deformation under load, the downwardly and outwardly extending flange or skirt 30′ is formed with a peripheral flange 36′.

The disposable support S′ is a moulded one piece unit comprising a flat base 20′, generally circular in plan view but the front whereof terminates at a straight edge 21′. Extending upwardly from the curved periphery of the base 20′ is an outwardly sloping wall 22′ which is connected with a downwardly and outwardly sloping skirt or flange 23′ by a flat web 24′. At the front said wall 22′ and skirt or flange 23′ are connected by relatively flat wall portions 26′. To prevent spreading of the skirt 23′ under load, the outer periphery thereof is formed with a horizontal flange 28′ which is co-planar with the base 20′.

The support S′ is configurated and dimensioned so as to be a snug fit around the rear part of the bedpan $B^2$ with the web 24′ seated below the seat portion 34′ of the bedpan.

It will be seen that a bedpan-cum-support may be supplied as an assembly, ready for use, may be separated in order that the disposable bedpan can be used with a non-disposable support if circumstances are such that this is desirable.

What I claim is:

1. In combination, an assembly comprising a bedpan of a disposable fibrous pulp material having a seat portion provided with a downturned peripheral lip, a receptacle portion provided within said seat portion and having downwardly convergent side walls, said receptacle portion being elongated from the front to the rear and being bilobate in plan view with the rear part of greater radius than the forepart, and a support of a disposable fibrous pulp material being fitted around the rear part of said bedpan, said support being a one-piece unit comprising a planar base generally circular in shape with a front chordal edge, a divergent wall extending upwardly from the curved periphery of said base and connected to a downwardly divergent skirt by an upper generally horizontal web, and said wall and skirt being connected at the front by conic wall sections, and said support being arranged fitting snugly around the rear part of the bilobate receptacle portion of said bedpan with said front conic wall sections of said support being located in the waisted sides of said receptacle portion.

2. In combination, an assembly as claimed in claim 1, wherein the downwardly and outwardly extending skirt of said support is formed with a horizontal flange coplanar with said generally circular planar base.

3. In combination, an assembly as claimed in claim 2, wherein the bottom of the receptacle portion of said bedpan is provided with a joggle whereby the base of said support is coplanar with that part of said bedpan base not covered by said base of said support.

4. In combination, an assembly as claimed in claim 3, wherein said bedpan is provided with a downwardly and outwardly extending flange around the rear part of said bedpan, and said flange extends to base datum level at each side and tapers upwardly towards the front.

5. In combination, an assembly as claimed in claim 4, wherein said divergent wall and downwardly extending skirt of said support are provided with vertically extending flutes to increase their rigidity and load bearing character.

* * * * *

UNITED STATES PATENT AND TRADEMARK OFFICE

CERTIFICATE OF CORRECTION

PATENT NO. : 3,962,732

DATED : June 15,1976

INVENTOR(S) : Kenneth Wilson Mills

It is certified that error appears in the above-identified patent and that said Letters Patent are hereby corrected as shown below:

Include the following: " Claims Priority, application British No. 21179 filed May 14,1974. "

Signed and Sealed this

Fourteenth Day of September 1976

[SEAL]

*Attest:*

RUTH C. MASON
*Attesting Officer*

C. MARSHALL DANN
*Commissioner of Patents and Trademarks*